United States Patent [19]

Johnston

[11] 4,435,266

[45] Mar. 6, 1984

[54] ELECTROPLATING ARRANGEMENTS

[75] Inventor: Samuel J. B. Johnston, Ashford, England

[73] Assignee: EMI Limited, Hayes, England

[21] Appl. No.: 428,525

[22] Filed: Sep. 30, 1982

[30] Foreign Application Priority Data

Oct. 1, 1981 [GB] United Kingdom ..... 8129625

[51] Int. Cl.[3] ..... C25D 21/12

[52] U.S. Cl. ..... 204/276

[58] Field of Search ..... 204/5, 273, 275, 276, 204/212

[56] References Cited

U.S. PATENT DOCUMENTS

| | | | |
|---|---|---|---|
| 3,186,932 | 6/1965 | Gelfand | 204/5 |
| 4,269,669 | 5/1981 | Soby | 204/275 |
| 4,341,613 | 7/1982 | Prusak | 204/5 |
| 4,359,375 | 11/1982 | Smith | 204/212 |

FOREIGN PATENT DOCUMENTS

| | | | |
|---|---|---|---|
| 1503553 | 10/1967 | France | 204/5 |

*Primary Examiner*—T. M. Tufariello

*Attorney, Agent, or Firm*—Fleit, Jacobson, Cohn & Price

[57] ABSTRACT

An electroplating arrangement having particular use in the manufacture of stamper plates for disc record production comprises a rectangular plating bath, one side being non-vertical with respect to the bath base. A filter screen divides the bath into an anode region and a cathode region, the region including anode and cathode electrode arrangements respectively.

A stamper plate to be plated is mounted on the cathode electrode arrangement which is connected to a motor capable of rotating the arrangement about an axis perpendicular to the plate. The anode arrangement comprises an elongate porous bag containing anode material and is disposed parallel to the cathode arrangement and non-vertical wall. An electrolyte input pipe extends through the bag and screen to lie opposite the mounted stamper plate directing inflowing electrolyte thereat. An output exit is disposed within the anode region on the bath base such that the anode arrangement lies within the flowpath from said entrance to said exit.

12 Claims, 1 Drawing Figure

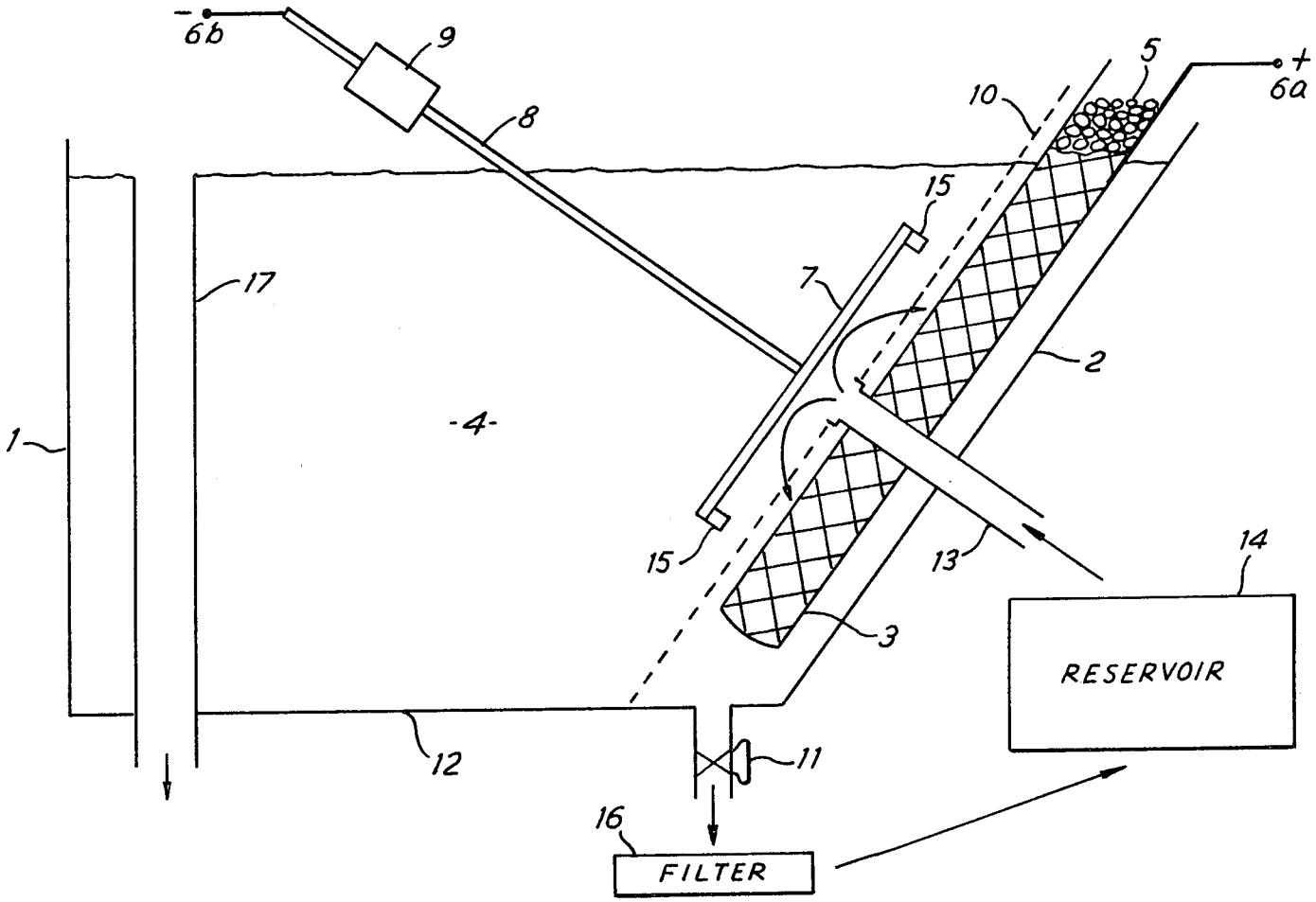
+
6a
5
10
15
7
8
9
-
6b
17
1
2
3
13
14
RESERVOIR
15
11
FILTER
16
12
-4-

ELECTROPLATING ARRANGEMENTS

The invention relates to electroplating arrangements and in particular to the use of electroplating baths in the formation of stamper plates for moulding disc records.

It is well known that a negative impression of a recording may be formed on a stamper plate, which may be utilized to create a positive impression by moulding a plastics material to form a disc record. Typically, nickel electroplating is involved in the production of stamper plates, which require a high quality surface finish. Demands for increased plating rates must be balanced against the surface physical characteristics required. A typical problem encountered with the higher current densities necessary for faster electro plating is the formation of nodules on the plated surface, resulting in defects being formed on the disc record. Nodules are generally a consequence of particulate and organic contamination of the electroplating electrolyte, necessitating stringent filtering techniques.

It is an object of this invention to provide an improved electroplating arrangement, reducing impurity contamination and allowing substantially nodule free electroplating at higher current densities.

According to the invention there is provided an electroplating apparatus, for forming a disc record stamper plate, comprising a bath capable of holding an electrolyte, a filter screen dividing said bath into a cathode region and an anode region, a cathode, at which said stamper plate is formed, in said cathode region, an anode in said anode region, said anode facing and lying substantially parallel to said cathode, said anode comprising anode material in the form of pellets contained in an open mesh container, an electrolyte inlet pipe entering said cathode region through said anode with an open end protruding through said filter screen to face said cathode, and an electrolyte outlet in said anode region, circulating means operative in use of the apparatus to continuously circulate electrolyte through said bath, said circulating means including pump means connected between said outlet and said inlet pipe to create a high pressure region between said filter screen and said cathode thereby continuously flushing the cathode with fresh electrolyte and creating a major return flow path to said outlet directly through said screen and through said anode which substantially purges said anode of contaminating material.

For a better understanding of the present invention, and to show how the same may be carried into effect, reference will now be made by way of example only, to the accompanying drawing, the single FIGURE of which illustrates an electroplating arrangement in accordance with one example of the invention.

An electroplating bath arrangement comprises an inclined plating cell 1, a side wall 2 of which, is set at an angle to vertical, preferably 30°. An anode bag 3 is disposed adjacent wall 2 and comprises typically an open mesh titanium basket retaining anode material 5 and permitting free flow of electrolyte 4 through the anode material, which may conveniently be in the form of pellets. A continuous anode feed system can be operated by addition of further pellets through the open end of node bag 3 as anode material is consumed. Electrical connection is made between the anode bag and the positive terminal **6*a*** of a power supply (not shown) by any suitable means, for example mechanical connections.

A cathode 7 is located adjacent and parallel to the anode bag and spaced therefrom by a gap of 2 inches for example. The cathode may have attached to it an article to be electroplated, for example a stamper plate (not shown). A shaft 8 of a motor 9 is connected by suitable means to the cathode 7, allowing it to be rotated by the motor 9. The shaft 8 is electrically conducting and connected by suitable means to the negative terminal **6*b* of the aforementioned power supply. Therefore, the shaft 8, which is electrically isolated from the motor 9, maintains the cathode 7** at a negative potential.

A filter screen 10 having a mesh dimension of 2 microns for example, is disposed between the anode and cathode thus defining an anode region between the filter screen and anode, and a cathode region between the filter screen and cathode. An adjustable valve 11 is set into base 12 of the plating cell 1, and located on the anode side of the filter screen 10. Both cell and valve typically comprise materials unlikely to be reactive in the plating environment. A tube 13 of electrically insulating plastics material for example, is arranged to pass through anode bag 3 with its end-point arranged to rest just through filter screen 10. Some form of shaped tube end-point may be used. Fresh electrolyte from a reservoir 14 is pumped through pipe 13 towards cathode 7, creating a high pressure zone immediately adjacent the cathode. This may be accentuated by the provision for example, of a ring of plastics material 15 around the perimeter of the cathode 7. Incomplete rings and other shapes and materials may achieve the same result.

Valve 11 may be adjusted to allow a flow volume equivalent to 80–90% of that entering through tube 13 to pass out of the cell. Consequently the electrolyte in the high pressure zone around cathode 7 may pass through the anode area as illustrated, cleaning the bag and removing suspended inpurities. This impure electrolyte subsequently passes out of the cell through valve 11, where it is filtered by a filter 16 before returning to the reservoir 14. The remaining 10–20% of electrolyte which typically escapes around pieces 15, passes out of the cell through an overflow pipe 17 before filtering and return to the reservoir 14.

By means of this arrangement fresh electrolyte from the reservoir is supplied to the cathode area and a flow towards the anode is created that purges the anode bag of any particulate matter likely to encourage nodule formation; the contaminated elecyrolyte is rapidly removed from the bath and purified for re-use.

The electroplating bath disclosed hereinabove is of particular use with nickel electroplating employed in the formation of stamper plates utilized in the manufacture of audio and video disc records. The electrolyte solution includes a major proportion of nickel sulphamate and a minor proportion of nickel chloride dissolved in a buffered aqueous solution. For increased plating uniformity, the cathode may be rotated, at 150 r.p.m. for example. By the use of a continuous nickel anode feed system and a bath electrolyte change rate of 8–10 times an hour, substantially nodule free stamper plates have been produced for current densities of up to 400 ASF.

It will be understood that the embodiment illustrated shows an application of the invention in one form only for the purposes of illustration. In practise the invention may be utilized for many different applications, the detailed embodiments being straightforward for those skilled in the art to implement.

I claim:

1. An electroplating apparatus, for forming a disc record stamper plate, comprising a bath capable of holding an electrolyte, a filter screen dividing said bath into a cathode region and an anode region, a cathode, at which said stamper plate is formed, in said cathode region, an anode in said anode region, said anode facing and lying substantially parallel to said cathode, said anode comprising anode material in the form of pellets contained in an open mesh container, an electrolyte inlet pipe entering said cathode region through said anode with an open end protruding through said filter screen to face said cathode, and an electrolyte outlet in said anode region, circulating means operative in use of the apparatus to continuously circulate electrolyte through said bath, said circulating means including pump means connected between said outlet and said inlet pipe to create a high pressure region between said filter screen and said cathode thereby continuously flushing the cathode with fresh electrolyte and creating a major return flow path to said outlet directly through said screen and through said anode which substantially purges said anode of contaminating material.

2. An apparatus according to claim 1 wherein said open end of said inlet pipe faces said cathode in a substantially central position.

3. An apparatus according to claim 1 in which said cathode is mounted for rotation about an axis and a motor is provided to rotate said cathode about said axis.

4. An apparatus according to claim 1 wherein said bath has a base and four side walls, one of said side walls being non-vertical and lying substantially parallel to said cathode, said inlet pipe entering said bath through said non-vertical side wall.

5. An apparatus according to claim 4 wherein said non-vertical side wall is set at substantially 30° to the vertical.

6. An apparatus according to claim 4 wherein said outlet is disposed at said base.

7. An apparatus according to claim 1 wherein, in use, a filter is connected between said outlet and said pump means.

8. An apparatus according to claim 1 wherein said cathode is provided with a substantially annular ring shaped to encircle said stamper plate and protuding therefrom to enhance the electrolyte flow away from said cathode towards said anode.

9. An apparatus according to claim 1 including an overflow pipe, said overflow pipe in use being connected to said pump means such that a minor proportion of the total circulating electrolyte flows through said overflow pipe.

10. An apparatus according to claim 9 wherein said minor proportion lies within the range 10% to 20% of said total circulating electrolyte.

11. An apparatus according to claim 9 including adjustable valve, located at said electrolyte outlet, to control the extent of said minor proportion.

12. An apparatus according to claim 1 which is capable of forming substantially nodule free stamper plates when operating at a current density of substantially 400 amperes per square foot and with a bath electrolyte change rate within the range 8 to 10 changes per hour.

* * * * *